US011466519B2

(12) United States Patent
Cosse

(10) Patent No.: US 11,466,519 B2
(45) Date of Patent: Oct. 11, 2022

(54) SHEAR COUPLING

(71) Applicant: OPW-Engineered System, Inc., Lebanon, OH (US)

(72) Inventor: Carlos Cosse, Calgary (CA)

(73) Assignee: KNAPPCO, LLC, Hamilton, OH (US)

( * ) Notice: Subject to any disclaimer, the term of this patent is extended or adjusted under 35 U.S.C. 154(b) by 920 days.

(21) Appl. No.: 16/019,073

(22) Filed: Jun. 26, 2018

(65) Prior Publication Data

US 2019/0010768 A1 Jan. 10, 2019

Related U.S. Application Data

(60) Provisional application No. 62/529,813, filed on Jul. 7, 2017.

(51) Int. Cl.
*E21B 17/046* (2006.01)
*E21B 17/06* (2006.01)
*E21B 43/12* (2006.01)

(52) U.S. Cl.
CPC ..... *E21B 17/046* (2013.01); *E21B 17/06* (2013.01); *E21B 43/126* (2013.01)

(58) Field of Classification Search
CPC ..... E21B 17/046; E21B 17/06; Y10T 403/11
See application file for complete search history.

(56) References Cited

U.S. PATENT DOCUMENTS 5,470,118 A * 11/1995 Burton ..... E21B 17/06 294/86.18
5,586,611 A * 12/1996 Dorosz ..... E21B 10/22 175/369
9,803,449 B2 * 10/2017 Good, III ..... B32B 1/08
10,221,633 B2 * 3/2019 Wollmann ..... E21B 17/1071
2002/0179305 A1 * 12/2002 Mack ..... F04D 13/10 166/377
2011/0150596 A1 * 6/2011 Wolodko ..... F16D 9/08 411/5

* cited by examiner

*Primary Examiner* — Jonathan Malikasim
(74) *Attorney, Agent, or Firm* — Workman Nydegger

(57) ABSTRACT

A shear coupling includes a first half, a second half, and a shear pin connected therebetween. The connections between the shear pin and the first half and the second half substantially isolate the shear pin from torsional, bending, and compression forces experienced by the first half or the second half. The connections between the shear pin and the first half and the second half transfer tension forces experienced by the first half and the second half to the shear pin from. A tension force above a predetermined threshold causes the shear pin to separate into two pieces that remain connected to the first and second halves.

28 Claims, 3 Drawing Sheets

SHEAR COUPLING

This application claims priority to and the benefit of U.S. Provisional Application No. 62/529,813, filed Jul. 7, 2017, and entitled SHEAR COUPLING, the entire content of which is incorporated herein by reference.

BACKGROUND

1. Technical Field

Exemplary embodiments of the present disclosure relate to couplings. More particularly, exemplary embodiments of the present disclosure relate to shear couplings that preferentially fail and separate into two halves upon the application of a tension force above a threshold level.

2. The Relevant Technology

Downhole pumps are positioned and activated in a wellbore by a rod string extending from surface. The rod string is typically either one continuous member or a plurality of sucker rods, connected end-to-end through standard threaded couplings. In some cases, sand or other debris can get lodged between the pump and the wellbore, causing the pump to become stuck in the wellbore. The pump can get stuck at the downhole pumping location or as the pump is being retrieved from the wellbore.

A downhole pump is usually removed from a wellbore by applying a pulling or tension force on the associated rod string. A shear coupling is typically used to connect the pump and the lower end of the rod string. In the event that the pump becomes lodged in the wellbore, the shear coupling separates (to disconnect the rod string and the pump) to allow the rod string to be removed from the wellbore without being damaged. Once the rod string is removed, specialized equipment can be inserted into the wellbore to dislodge and remove the pump. Without the use of a shear coupling, the rod string may break at a location along the length of the rod string that is unknown and largely unpredictable, and which can be problematic for retrieving the pump. Also, a continuous member rod string needs to be replaced, which is considerably more expensive than just replacing the shear coupling.

Typical shear couplings use transversely extending shear pins for joining male and female coupling members between the pump and the rod string. The shear pins are known to be prone to premature fatigue which arises from cyclic compressive stress induced in the shear pins in a reciprocating pump if the rod string taps down at the base of each reciprocating stroke. Additionally, when the shear pins break, fragments fall downhole and can become lodged between the pump and the wellbore, making it more difficult to retrieve the pump. In some cases, the only way to retrieve a lodged pump is to pull the whole tubing, which requires bigger, more expensive equipment than the equipment used to pull the pump only.

Thus, there is additional room for improvement in the area of shear couplings.

BRIEF SUMMARY

Exemplary embodiments of the present disclosure relate to shear couplings that preferentially fail upon the application of a tension force above a predetermined threshold. For example, a shear coupling can include a first half, a second half, and a shear pin connected therebetween. The connection between the first half and the second half substantially isolates the shear pin from torsional, bending, and compression forces experienced by the first half or the second half. The connections between the shear pin and the first half and the second half transfer tension forces experienced by the first half and the second half to the shear pin. A tension force above a predetermined threshold causes the shear pin to separate into two pieces that remain connected to the first and second halves, respectively. In some embodiments, the shear pin includes a shear groove where the shear pin predictably separates upon the application of the tension force above the predetermined level.

In some cases, a first end of the shear pin is connected to the first half with a bushing. The bushing can be disposed about a shaft portion of the shear pin. The bushing can be a split bushing having a first half and a second half. The first half of the bushing and the second half of the bushing can cooperate to define a bore through the bushing. The bore can be adapted to receive the shaft portion of the shear pin therein. The bushing can engage a shoulder on the shear pin to retain the first end of the shear pin within the first half and a retention ring can retain the bushing within the first half. In some embodiments, the bushing includes external threads that engage threads on an interior surface of the first half.

In some embodiments, a second end of the shear pin includes external threads that engage threads on an interior surface of the second half. Additionally, a retention assembly can be connected between the second end of the shear pin and the second half to prevent unintentional disengagement (e.g., unthreading) of the shear pin and the second half.

The shear coupling can include interlocking fingers on the first half and the second half. The interlocking fingers can be adapted to transfer torsional, bending, or compression forces between the first half and the second half.

Another example embodiment includes a shear pin that can be used in a shear coupling. The shear pin can include a shaft portion having a generally circular cross-sectional shape. A shoulder can be formed adjacent to the shaft portion and a first end of the shear pin. An externally threaded portion can be disposed adjacent to a second end of the shear pin. A shear groove can be formed in a surface of the shear pin. The shear pin can be adapted to predictably separate at the shear groove when a tension force above a predetermined level is applied to the shear pin. In some embodiments, the shoulder and the externally threaded portion are formed on opposite sides of the shear groove. The shoulder can have a diameter that is larger than a diameter of the shaft portion.

These and other objects and features of the present disclosure will become more fully apparent from the following description and appended claims, or may be learned by the practice of the disclosed embodiments as set forth hereinafter.

BRIEF DESCRIPTION OF THE DRAWINGS

To further clarify the above and other advantages and features of the present disclosure, a more particular description will be rendered by reference to specific embodiments thereof which are illustrated in the appended drawings. It is appreciated that these drawings depict only typical embodiments and are therefore not to be considered limiting of its scope, nor are the drawings necessarily drawn to scale. The disclosure will be described and explained with additional specificity and detail through the use of the accompanying drawings in which.

DETAILED DESCRIPTION

Reference will now be made to the drawings to describe various aspects of exemplary embodiments of the disclosure. It is understood that the drawings are diagrammatic and schematic representations of such exemplary embodiments, and are not limiting of the present disclosure. While the drawings are not necessarily drawn to scale, the drawings may be to scale for some embodiments. No inference should therefore be drawn from the drawings as to the dimensions of any embodiment or element, unless indicated otherwise. In the following description, numerous specific details are set forth in order to provide a thorough understanding of the present disclosure. It will be obvious, however, to one of ordinary skill in the art that the present disclosure may be practiced without these specific details.

While the various features of the present disclosure are hereinafter illustrated and described as being particularly adaptable to downhole systems, it is to be understood that various features of the present disclosure can be utilized singly or in any combination thereof to provide shear couplings for use in any field where a shear coupling is desired.

Figure 1:
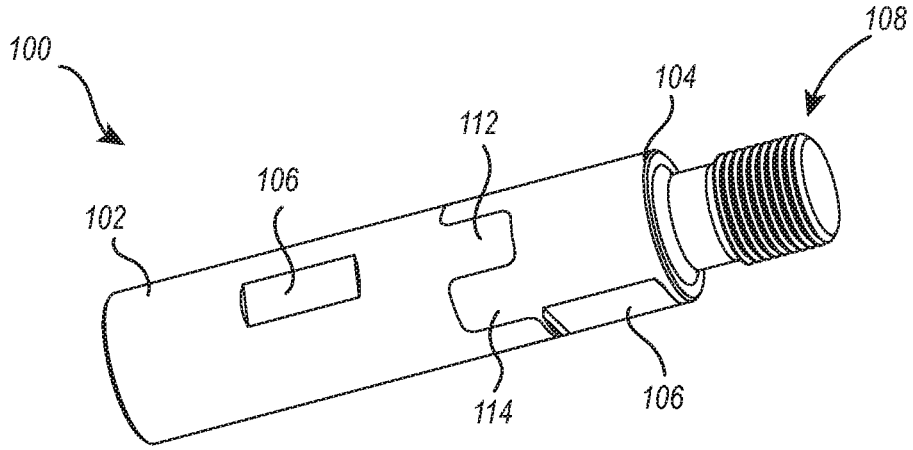
FIG. 1 is a perspective view of the shear coupling according to one embodiment of the present disclosure.

Turning now to FIG. 1, there is illustrated an exemplary embodiment of a shear coupling 100 that can be used to connect a downhole pump to a rod string. As will be discussed in greater detail below, the shear coupling 100 is designed to preferentially fail or separate into two halves upon the application of a tension force above a predetermined threshold level.

As can be seen in FIG. 1, the shear coupling 100 includes a first half 102 and a second half 104 that can be connected together in the manner described below. In some embodiments, the first half 102 can be connected to a downhole pump and the second half 104 can be connected to a rod string. In other embodiments, the first half 102 can be connected to a rod string and the second half 104 can be connected to the downhole pump. Furthermore, in other embodiments, the first half 102 and the second half 104 can be connected to components of other systems unrelated to downhole pump systems.

In the illustrated embodiment, the first half 102 and the second half 104 each include flats 106 formed an exterior surfaces thereof. The flats 106 can facilitate the attachment of the first half 102 and the second half 104 to other components. For instance, a wrench or other tool can engage the flats 106 on the second half 104 and the wrench or other tool can be used to rotate the second half 104 to threadably engage a threaded portion 108 of the second half 104 into another component (e.g., a rod string). Similarly, a wrench or other tool can engage the flats on the first half 102 and the wrench or other tool can be used to rotate the first half 102 to threadably engage a threaded portion 110 (see FIG. 3) of the first half 102 onto another component (e.g., a downhole pump).

As can be seen in FIG. 1, the first half 102 includes fingers 112 and the second half 104 include fingers 114. The fingers 112, 114 interlock with one another as illustrated. The interlocking of the fingers 112, 114 facilitates the transfer of torsional, bending, and compression forces between the first half 102 and the second half 104 primarily or (substantially) exclusively through the fingers 112, 114. As will be discussed in greater detail below, the transfer of these forces through the fingers 112, 114 limits or prevents torsional forces being applied to a shear pin disposed within shear coupling 100.

The number and configuration of the fingers 112, 114 can vary from one embodiment to another. For instance, in the illustrated embodiment, there are four fingers 112 and four fingers 114, each of which is generally square or rectangular in shape. In other embodiments, there may be as few as one finger on each of the first half 102 and the second half 104 or any number desired. Similarly, some or all of the fingers may have non-square or non-rectangular shapes. For instance, some or all of the fingers may be triangular or semi-circular.

Figure 2:
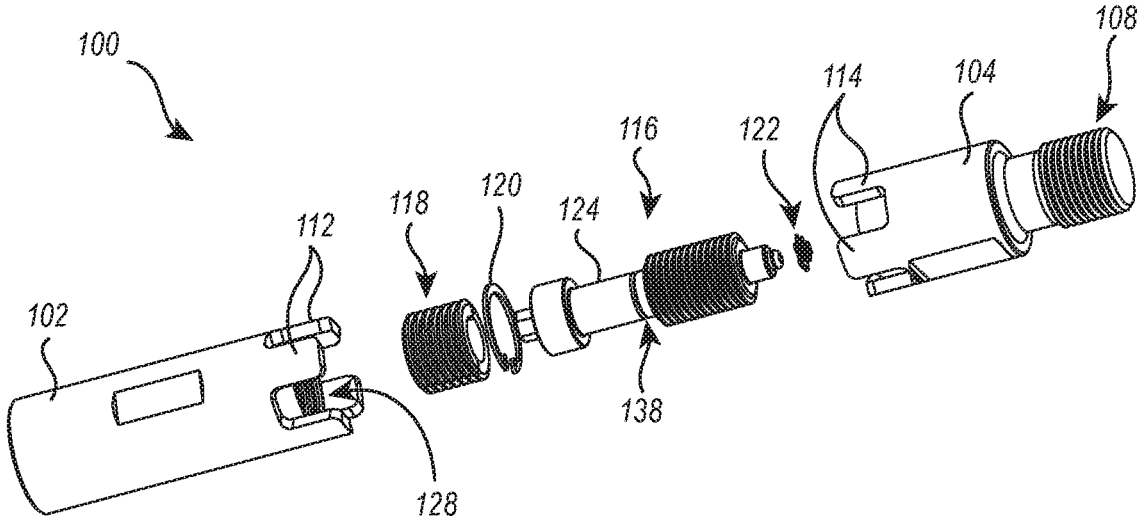
FIG. 2 is an exploded view of the shear coupling of FIG. 1.
Figure 3:
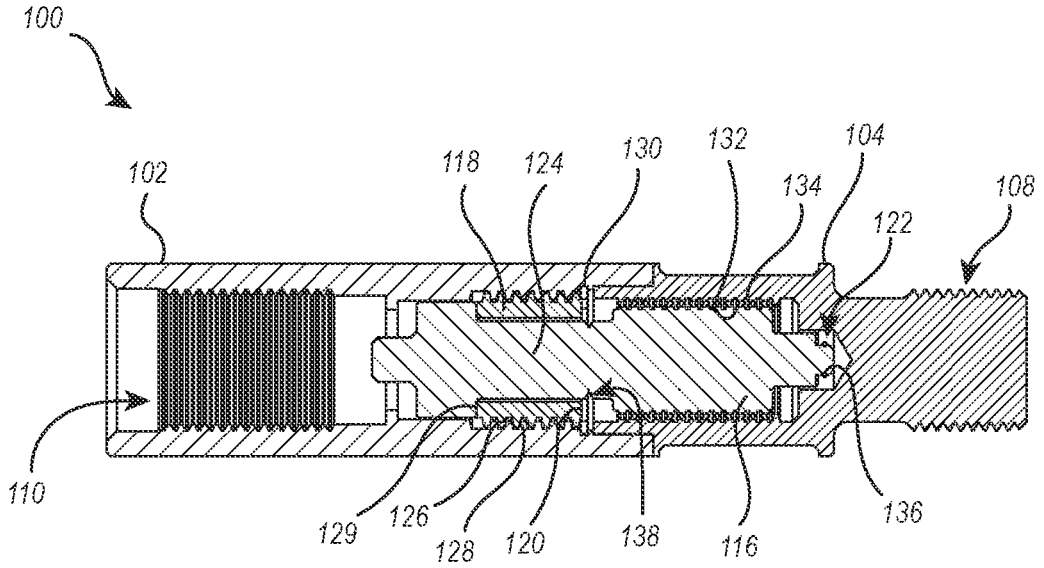
FIG. 3 is a cross-sectional view of the shear coupling of FIG. 1.

Attention is now directed to FIGS. 2 and 3, which illustrate exploded and cross-sectional views of shear coupling 100. As can be seen, in addition to the first half 102 and the second half 104, shear coupling 100 includes various internal components that are disposed within the first half 102 and the second half 104 when the first half 102 and the second half 104 are connected together. The internal components include a shear pin 116, a bushing 118, a retention ring 120, and a retention assembly 122.

Figure 4:
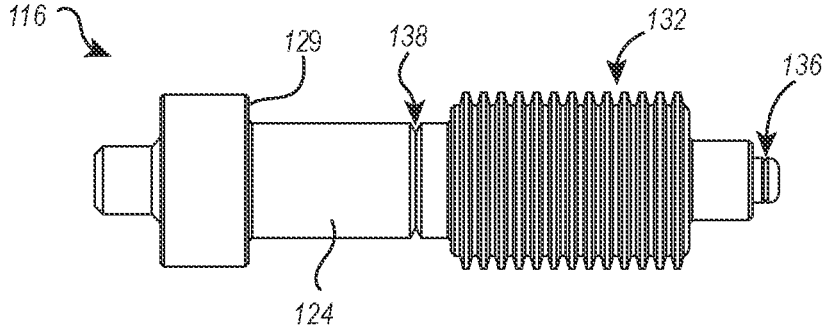
FIG. 4 is a side view of a shear pin of the shear coupling of FIG. 1.

As can be seen in FIG. 3, a first end of the shear pin 116 can be disposed and secured within the first half 102 of the shear coupling 100. In discussing the connection between the shear pin 116 and the first half 102 as shown in FIG. 3, attention is also directed to FIGS. 4 and 5, which illustrate a side view of the shear pin 116 and a perspective view of the bushing 118.

Figure 5:
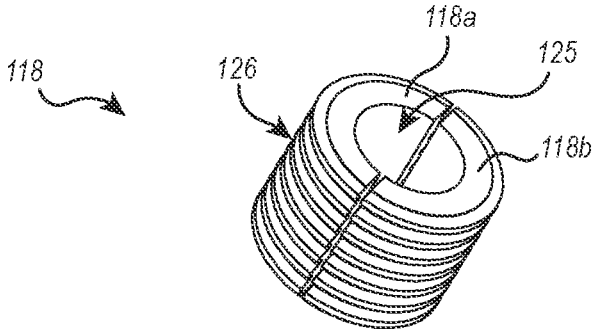
FIG. 5 is a perspective view of a split bushing of the shear coupling of FIG. 1.

The first end of the shear pin 116 can be secured within the first half 102 via the bushing 118 and the retention ring 120. The bushing 118 can be disposed about a shaft portion 124 of the shear pin 116. More specifically, as shown in FIG. 5, the bushing 118 can take the form of a split bushing that includes a first half 118*a* and a second half 118*b*. The first and second halves 118*a*, 118*b* can be separated and disposed on opposing sides of the shaft portion 124. The shaft portion 124 can have a generally circular cross-sectional shape that fits within a bore 125 formed by the first and second halves 118*a*, 118*b* of the bushing 118. The bore 125 can have a generally circular cross-sectional shape. The bushing 118 includes external threads 126 that interface with threads 128 formed on an interior surface of the first half 102 such that the bushing 118 can be threaded into the first half 102, as shown in FIG. 3.

When the bushing 118 is disposed about the shaft portion 124, the bushing 118 engages a shoulder 129 disposed adjacent to the first end of the shear pin 116. When the bushing 118 is threaded into the first half 102, the engagement between the bushing 118 and the shoulder 129 causes the first end of the shear pin 116 to be advanced into the first half 102. Once the bushing 118 is threaded into the first half 102, the retention ring 120 (e.g., C-shaped snap ring) can be inserted into the first half 102 to prevent the bushing 118 from unthreading from the first half 102. The retention ring 120 can interface with a groove 130 or other structural feature on an interior surface of the first half 102 to maintain the retention ring 120 in place and prevent the bushing 118 from unthreading from the first half 102.

As can also be seen in FIG. 3, a second end of the shear pin 116 can be disposed and secured within the second half 104 of the shear coupling 100. More specifically, the second end of the shear pin 116 can be secured within the second half 104 via a threaded connection. The second end of the shear pin 116 includes external threads 132 that interface with threads 134 formed on an interior surface of the second half 104 such that the second end of the shear pin 116 can be threaded into the second half 104.

The retention assembly 122 can further secure the second end of the shear pin 116 within the second half 104 and prevent the shear pin 116 from undesirably unthreading from the second half 104. For instance, the retention assembly 122 can include a retention ring (e.g., C-shaped snap ring) and/or a star-shaped ring that engages both the second end of the shear pin 116 and the interior of the second half 104. In some embodiments, the retention assembly 122 engages a groove 136 or other structural feature formed in an exterior surface of the shear pin 116. Likewise, in some embodiments the retention assembly 122 engages a groove or other structural feature formed on an interior surface of the second half 104.

Disposing and securing the shear pin 116 within the first half 102 and the second half 104 as described above substantially isolates the shear pin 116 from many forces, including torsional forces, experienced by the first and second halves 102, 104, except for tension forces. More specifically, securing the first end of the shear pin 116 within the first half 102 via the bushing 118 allows for relative torsional movement between the shear pin 116 and the bushing 118 because the bushing 118 can rotate or twist about the shear pin 116. As a result, any torsional forces applied to either the first half 102 or the second half 104 are transferred to the other via the fingers 112, 114 and not through the shear pin 116.

The primary forces that are transferred from the first and second halves 102, 104 to the shear pin 116 are tension forces. For example, when a tension force is applied to the rod string to pull the rod string up the wellbore, the tension force is transferred to the shear coupling 100 via the connection between the rod string and the second half 104. The second half 104 is connected to the first half 102 via the connections between the shear pin 116 and the first and second halves 102, 104. Thus, the tension force is transferred from the second half 104 to the shear pin 116 via the threaded connection therebetween and/or the engagement of the retention assembly 122 therebetween. The tension force is then transferred from the shear pin 116 to the first half 102 via the bushing 118. More specifically, the tension force is transferred from the shear pin 116 to the bushing 118 via the engagement of the shoulder 129 with the bushing 118. The bushing 118 then transfers the tension force to the first half 102 via the threaded connection therebetween. The tension force is then transferred from the first half 102 to a component connected thereto (e.g., a downhole pump).

In the event the tension force applied to the shear coupling 100 exceeds a predetermined threshold, the shear pin 116 can separate or break in half. For example, if a downhole pump becomes lodged within a wellbore and a tension force applied to a rod string exceeds the predetermined threshold, the shear pin 116 can break or separate into two pieces. Breaking or separating the shear pin 116 into two pieces can disengage the rod string from the downhole pump and prevent damage being done to either the downhole pump or the rod string.

In some embodiments, including the illustrated embodiment, the shear pin 116 is designed to predictably break or separate into two pieces or halves upon the application of a tension force above the predetermined threshold. For instance, the shear pin 116 may include an area of weakness or reduced strength that is designed to preferentially and predictably fail upon the application of a tension force above a predetermined threshold. In the illustrated embodiment (see FIGS. 2-4), the shear pin 116 includes a shear groove 138 that limits the strength of the shear pin 116 or the ability of the shear pin 116 to withstand tension forces above a predetermined threshold. Upon the application of a tension force to the shear pin 116 above the predetermined threshold, the shear pin 116 breaks or separates at the shear groove 138.

Figure 6:
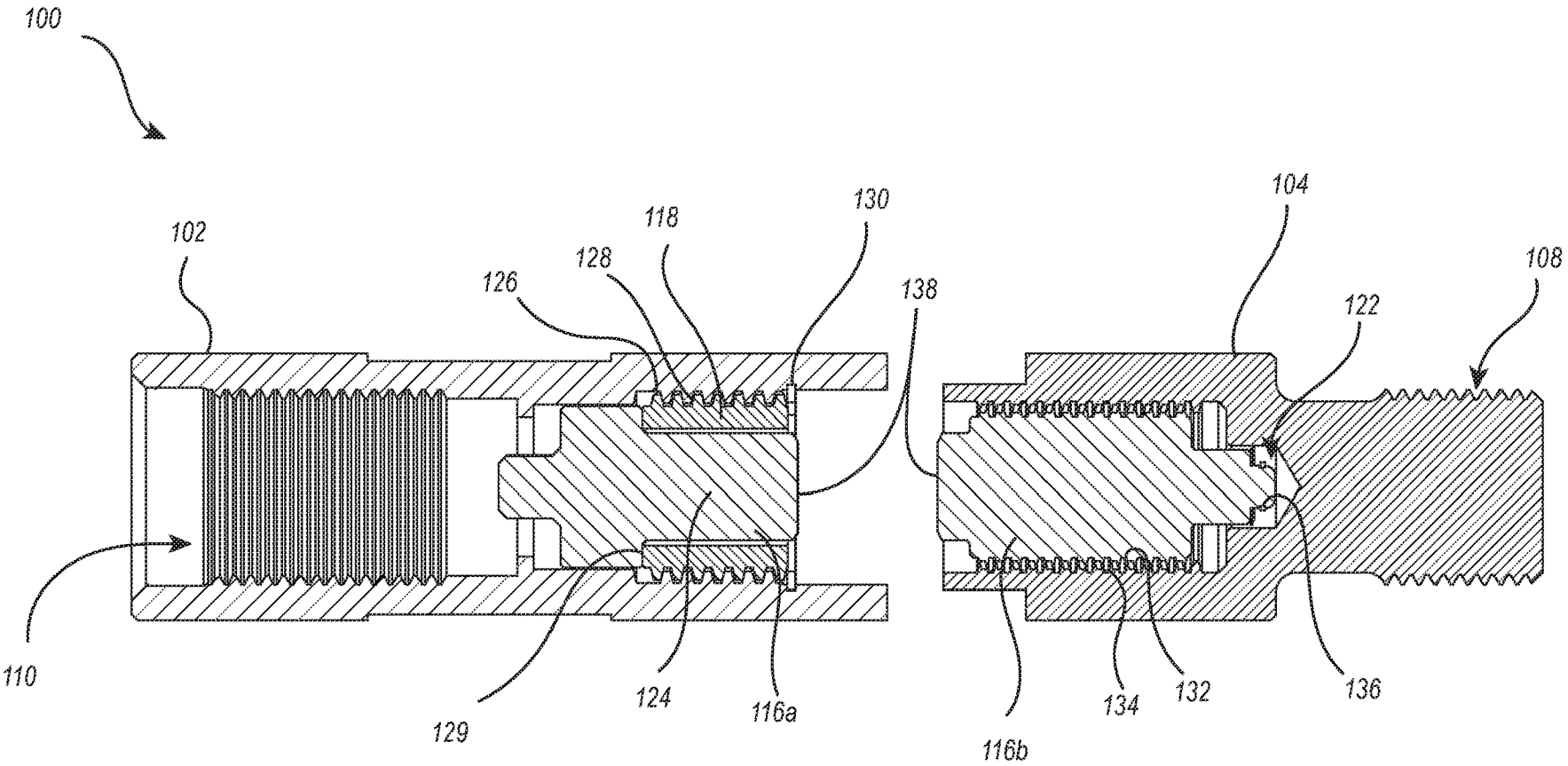
FIG. 6 is a cross-sectional view of the shear coupling of FIG. 1 shown separated into two halves.

Notably, even when the shear pin 116 breaks into two halves at the shear groove 138, the two halves remain connected to the respective first and second halves 102, 104. For instance, FIG. 6 illustrates the shear coupling 100 after a tension force above a predetermined threshold is applied to the shear coupling 100. As can be seen, as a result of the tension force, the shear pin 116 has broken or separated at the shear groove 138 into two halves 116*a*, 116*b*. Nevertheless, the first end or half 116*a* of the shear pin 116 remains connected within the first half 102 via the bushing 118 and the retention ring 120. Likewise, the second end or half 116*b* of the shear pin 116 remains connected within the second half 104 via the threaded connection (e.g., engaging threads 132, 134) and/or the engagement of the retention assembly 122 between the shear pin half 116*b* and the second half 104. As a result, neither half of the shear pin 116 is able to fall down the wellbore and become lodged between the pump and the wellbore.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A shear coupling, comprising:

a first half having a connection feature adapted to connect the first half to a first system component;

a second half having a connection feature adapted to connect the second half to a second system component;

a shear pin configured to be connected between the first half and the second half, the shear pin comprising a first end and a shoulder, the connections between the shear pin and the first half and the second half being adapted to substantially isolate the shear pin from torsional, bending, and compression forces experienced by the first half or the second half, the connections between the shear pin and the first half and the second half being adapted to transfer tension forces experienced by the first half and the second half to the shear pin; and a bushing configured to connect the first end of the shear pin to the first half and engage the shoulder to maintain the connection between the first end of the shear pin and the first half.

2. The shear coupling as recited in claim 1, wherein the shear pin is disposed at least partially within each of the first half and the second half.

3. The shear coupling as recited in claim 1, wherein the shear pin comprises a shear groove, wherein the shear pin is adapted to separate into two pieces at the shear groove when a tension force above a predetermined threshold is applied to the shear pin.

4. The shear coupling as recited in claim 3, wherein a first piece of the two pieces of the shear pin remains connected to the first half when the shear pin separates into the two pieces.

5. The shear coupling as recited in claim 3, wherein a second piece of the two pieces of the shear pin remains connected to the second half when the shear pin separates into the two pieces.

6. The shear coupling as recited in claim 1, wherein the shoulder is disposed adjacent to the first end of the shear pin.

7. The shear coupling as recited in claim 1, wherein the bushing is disposed about a shaft portion of the shear pin.

8. The shear coupling as recited in claim 7, wherein the bushing comprises a split bushing having a first half and a second half.

9. The shear coupling as recited in claim 8, wherein the first half of the bushing and the second half of the bushing cooperate to define a bore through the bushing, the bore being adapted to receive the shaft portion of the shear pin therein.

10. The shear coupling as recited in claim 7, wherein the shaft portion of the shear pin is disposed between the shoulder and a threaded portion on the shear pin, the threaded portion being disposed adjacent to a second end of the shear pin.

11. The shear coupling as recited in claim 1, wherein a retention ring is configured to selectively retain the bushing within the first half.

12. The shear coupling as recited in claim 1, wherein the bushing comprises external threads that engage threads on an interior surface of the first half.

13. The shear coupling as recited in claim 1, wherein a second end of the shear pin comprises external threads that engage threads on an interior surface of the second half.

14. The shear coupling as recited in claim 1, further comprising a retention assembly connected between a second end of the shear pin and the second half, the retention assembly being adapted to prevent unintentional disengagement of the shear pin and the second half.

15. The shear coupling as recited in claim 14, wherein the second end of the shear pin comprises a groove engaged with the retention assembly.

16. The shear coupling as recited in claim 1, wherein the first half and the second half comprise interlocking fingers.

17. The shear coupling as recited in claim 16, wherein the interlocking fingers are adapted to transfer torsional, bending, and compression forces between the first half and the second half.

18. The shear coupling as recited in claim 1, wherein the connection feature of the first half comprises threads formed on an interior surface thereof.

19. The shear coupling as recited in claim 1, wherein the connection feature of the second half comprises threads formed on an exterior surface thereof.

20. A shear coupling, comprising:

a first half comprising threads on an interior surface thereof and one or more interlocking fingers;

a second half comprising threads on an interior surface thereof and one or more interlocking fingers, the interlocking fingers being adapted to transfer torsional, bending, and compression forces between the first half and the second half;

a shear pin adapted to be connected between the first half and the second half, the shear pin comprising a shoulder disposed at a first end thereof, external threads disposed at a second end thereof, and a shaft extending between the shoulder and the external threads, the external threads being adapted to engage the threads on the interior surface of the second half to secure the shear pin to the second half, the shaft having a shear groove that is adapted to separate the shear pin into two pieces at the shear groove when a tension force above a predetermined threshold is applied to the shear pin; and a split bushing having a first half and a second half, the split bushing being disposed about the shaft of the shear pin, the split bushing having external threads that are configured to engage the threads on the interior surface of the first half to secure the shear pin to the first half;

wherein:

the connections between the shear pin and the first half and the second half are adapted to substantially isolate the shear pin from torsional, bending, and compression forces experienced by the first half or the second half; and the connections between the shear pin and the first half and the second half being adapted to transfer tension forces experienced by the first half and the second half to the shear pin.

21. The shear coupling as recited in claim 20, wherein:

a first piece of the two pieces of the shear pin remains connected to the first half when the shear pin separates into the two pieces; and a second piece of the two pieces of the shear pin remains connected to the second half when the shear pin separates into the two pieces.

22. The shear coupling as recited in claim 20, wherein the first half of the bushing and the second half of the bushing cooperate to define a bore through the bushing, the bore being adapted to receive the shaft of the shear pin therein.

23. The shear coupling as recited in claim 20, wherein the bushing engages the shoulder on the shear pin to retain the first end of the shear pin within the first half.

24. The shear coupling as recited in claim 20, wherein a retention ring is configured to selectively retain the bushing within the first half.

25. The shear coupling as recited in claim 20, further comprising a retention assembly connected between the second end of the shear pin and the second half, the retention assembly being adapted to prevent unintentional disengagement of the shear pin and the second half.

26. A shear pin for use in a shear coupling, the shear pin comprising:

a first end portion, the first end portion comprising a terminal end;

a second end portion opposite to the first end portion;

a shaft portion having a generally circular cross-sectional shape;

a shoulder formed between the shaft portion and the first end portion of the shear pin, the shoulder having a diameter that is larger than a diameter of the shaft portion;

one or more external surfaces extending between the terminal end of the first end portion and the shaft portion, the entirety of each of the one or more external surfaces extending between the terminal end of the first end portion and the shaft portion being devoid of external threads;

an externally threaded portion disposed between the shaft portion and the second end portion of the shear pin, the externally threaded portion disposed between the shaft portion and the second end portion being the only portion of the shear pin having external threads; and a shear groove formed in a surface of the shaft portion, the shear pin being adapted to separate at the shear groove when a tension force above a predetermined level is applied to the shear pin.

27. The shear pin as recited in claim 26, further comprising a groove formed in a surface of the second end portion and specifically adapted to engage a retention assembly.

28. The shear pin as recited in claim 26, wherein the shoulder and the externally threaded portion are formed on opposite sides of the shear groove.

* * * * *